US011225626B2

(12) United States Patent
Gheisari et al.

(10) Patent No.: US 11,225,626 B2
(45) Date of Patent: Jan. 18, 2022

(54) PHASE CHANGE MATERIAL COMPOSITIONS AND METHODS FOR THEIR USE TO LOWER SURFACE FRICTION AND WEAR

(71) Applicant: The Texas A&M University System, College Station, TX (US)

(72) Inventors: Reza Gheisari, College Station, TX (US); Andreas A. Polycarpou, College Station, TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 16/781,776

(22) Filed: Feb. 4, 2020

(65) Prior Publication Data

US 2020/0248090 A1 Aug. 6, 2020

Related U.S. Application Data

(60) Provisional application No. 62/800,804, filed on Feb. 4, 2019.

(51) Int. Cl.

| | |
|---|---|
| ***C10M 107/00*** | (2006.01) |
| ***C10M 111/04*** | (2006.01) |
| ***C10M 107/32*** | (2006.01) |
| ***C10M 107/38*** | (2006.01) |
| ***C10M 105/04*** | (2006.01) |
| ***C10M 107/12*** | (2006.01) |
| *C10N 30/06* | (2006.01) |
| *C10N 50/08* | (2006.01) |
| *C10N 50/00* | (2006.01) |

(52) U.S. Cl.

CPC ..... *C10M 111/04* (2013.01); *C10M 105/04* (2013.01); *C10M 107/12* (2013.01); *C10M 107/32* (2013.01); *C10M 107/38* (2013.01); *C10M 2203/0206* (2013.01); *C10M 2205/04* (2013.01); *C10M 2209/1023* (2013.01); *C10M 2213/0623* (2013.01); *C10N 2030/06* (2013.01); *C10N 2050/08* (2013.01); *C10N 2050/12* (2020.05)

(58) Field of Classification Search

CPC ..... C10M 111/04; C10M 107/32; C10M 107/38; C10M 105/04; C10M 2213/0623; C10M 2203/0206; C10M 2209/1023; C10M 169/044; C10M 2209/1033; C10M 2217/0443; C10M 2209/1105; C10M 2203/02; C10N 2030/06; C10N 2050/08; C10N 2050/12; C10N 2050/025; C10N 2020/065; C10N 2050/14

See application file for complete search history.

(56) References Cited

U.S. PATENT DOCUMENTS

| | | | | |
|---|---|---|---|---|
| 6,703,127 | B2 * | 3/2004 | Davis | B01J 13/046 428/402.2 |
| 2006/0086096 | A1 * | 4/2006 | Ghoshal | H05K 1/0204 62/3.2 |
| 2017/0333941 | A1 * | 11/2017 | Park | F28F 13/187 |

OTHER PUBLICATIONS

G. Mansoori, Characterization of Alkanes and Paraffin Waxes for Application as Phase Change Energy Storate Medium, 1994, Energy Sources Journal, Volumn 16, pp. 117-128 (Year: 1994).*

* cited by examiner

*Primary Examiner* — Taiwo Oladapo

(74) *Attorney, Agent, or Firm* — Christensen O'Connor Johnson Kindness PLLC

(57) ABSTRACT

Phase change material compositions and methods for using the compositions to prepare substrate coatings or bulk blended polymers that advantageously lower friction between interacting substrate surfaces and lower substrate surface wear.

17 Claims, 14 Drawing Sheets
(8 of 14 Drawing Sheet(s) Filed in Color)

| Compound Name | # of Carbon Atoms | Melting Point (°C.) |
|---|---|---|
| n- Octacosane | 28 | 61.4 |
| n-Heptacosane | 27 | 59.0 |
| n-Hexacosane | 26 | 56.4 |
| n-Pentacosane | 25 | 53.7 |
| n-Tetracosane | 24 | 50.9 |
| n-Tricosane | 23 | 47.6 |
| n-Docosane | 22 | 44.4 |
| n-Henelcosane | 21 | 40.5 |
| n-Elcosane | 20 | 36.8 |
| n-Nonadecane | 19 | 32.1 |
| n-Octadecane | 18 | 28.2 |
| n-Heptadecane | 17 | 22.0 |
| n-Hexadecane | 16 | 18.2 |
| n-Pentadecane | 15 | 10.0 |
| n-Tetredecane | 14 | 5.9 |
| n-Tridecane | 13 | -5.5 |

*FIG. 13*

PHASE CHANGE MATERIAL COMPOSITIONS AND METHODS FOR THEIR USE TO LOWER SURFACE FRICTION AND WEAR

CROSS-REFERENCE TO RELATED APPLICATION

This application claims the benefit of U.S. Application No. 62/800,804, filed Feb. 4, 2019, expressly incorporated herein by reference in its entirety.

BACKGROUND OF THE INVENTION

A phase change material (PCM) is a substance having the capability to store and release sufficient energy within a specific temperature range by melting and solidifying (e.g., a phase transition) to provide useful heating and cooling. Generally the phase transition is from one of the two fundamental states of matter, solid and liquid, to the other. The phase transition may also be between non-classical states of matter, such transition between crystalline forms, where the material goes from one crystalline structure to another, which may be a higher or lower energy state.

By melting and solidifying at the phase change temperature (PCT), a PCM is capable of storing and releasing large amounts of energy. Heat is absorbed or released when the material changes from solid to liquid and vice versa or when the internal structure of the material changes. PCMs are referred to as latent heat storage materials.

There are two principal classes of phase change materials: (1) organic (carbon-containing) materials derived from petroleum, from plants, or from animals; and (2) inorganic, such as salt hydrates (e.g., natural salts from the sea or from mineral deposits or are by-products of other processes). Solid to solid phase change materials are also known.

PCMs are used in many different commercial applications where energy storage and/or stable temperatures are required, for example, heating pads, cooling for telephone switching boxes, and clothing. PCMs are used mainly in the heat storage industry and cooling systems.

When two surfaces slide onto each other a resistance force, friction, is generated. Friction is an important source of energy waste and dissipation. Friction arising from resistance between surfaces, such as polymeric surfaces, increases the wear between the surfaces and increases energy consumption.

A need exists for phase change material compositions and methods for using phase change materials to reduce friction between interacting surfaces thereby decreasing wear and lowering energy consumption associated with the interacting surfaces. The present invention seeks to fulfill this need and further provides related advantages.

SUMMARY OF THE INVENTION

In one aspect, the invention provides a method for coating a substrate to enhance the tribological and mechanical performance of a coating. In one embodiment, the method comprises coating a surface of the substrate with a phase change material composition.

In certain embodiments, the phase change material composition is a combination of a phase change material and a polymeric material. In certain of these embodiments, the combination is a blend of the phase change material and a polymeric material. In certain embodiments, the coating is formed from a powdered phase change material and a powdered polymeric material.

In one embodiment, the invention provides a bulk blend polymer. In certain of these embodiments, the bulk blend polymers are formed from a powdered phase change material and a powdered/granular polymeric material.

As used herein, in certain embodiments, the term "phase change material composition" refers to a phase change material coated on a polymeric, ceramic, metallic, alloy, or composite material. In certain of these embodiments, the phase change material forms a film on the polymeric, ceramic, metallic, alloy, or composite material.

In certain embodiments, the method for coating a substrate described above further comprises heating the phase change material coated on the polymeric material to provide a coating wherein the phase change material is infused into the polymeric or other material.

In the methods of the invention, the phase change material is selected from organic, inorganic, or eutectic phase change materials. In certain embodiments, the phase change material is a paraffin. In certain of these embodiments, the phase change material is a paraffin having a melting point from about 40° C. to about 6.5° C.

For embodiments of the methods that utilize polymeric materials, suitable polymeric materials include aromatic thermosetting copolyesters, polyetherketones, polytetrafluoroethylenes, polyimides, and mixtures thereof. In certain embodiments, the polymeric material is an aromatic thermosetting copolyester ATSP).

For embodiments of the methods that utilize polymeric materials, in certain of these embodiments, the combination of the phase change material and the polymeric material comprises from about 2 to about 20 percent by weight phase change material. In certain embodiments, the polymeric material comprises from about 2 to about 5 percent by weight phase change material. In other embodiments, the polymeric material comprises from about 5 to about 10 percent by weight phase change material.

In certain embodiments, the phase change material composition is a phase change material encapsulated in an encapsulating polymer (e.g., MPCM or MEPCM). In certain of these embodiments, the phase change material is a paraffin. Representative paraffins include n-docosane and n-tricosane. In certain of these embodiments, the encapsulating polymer is a melamine-formaldehyde polymer, a polyurea-formaldehyde polymer, a polymethylmethacrylate polymer, or mixtures thereof.

The coating provided by the methods of the invention can have a varied thickness depending on the desired use. In certain embodiments, the coating has a thickness from about 35 to about 1 mm. In other embodiments, the coating has a thickness from about 35 to about 50 μm. In further embodiments, the coating has a thickness from about 50 to about 100 μm. In yet other embodiments, the coating has a thickness from about 100 μm to about 1 mm. When the coating has a thickness greater than about 1 mm, the coating constitutes a blended bulk material.

A variety of substrates are advantageously coated by the method of the invention. Suitable substrates include polymeric substrates (e.g., plastic or epoxy substrates), metallic substrates, metal alloy substrates (e.g., aluminum alloy substrates), ceramic substrates, and composite substrates. In certain embodiments, the substrate is a stainless steel substrate.

In another aspect, the invention provides a substrate having a surface coated with a phase change material prepared by the methods described herein.

DESCRIPTION OF THE DRAWINGS

The patent or application file contains at least one drawing executed in color. Copies of this patent or patent application publication with color drawings will be provided by the Office upon request and payment of the necessary fee.

The foregoing aspects and many of the attendant advantages of this invention will become more readily appreciated as the same become better understood by reference to the following detailed description, when taken in conjunction with the accompanying drawings.

FIG. 13 tabulated paraffins useful as PCMs in the methods of the invention.

DETAILED DESCRIPTION OF THE INVENTION

The present invention utilizes phase change materials (PCMs) for advantageously lowering friction between interacting surfaces, lowering surface wear, and reducing or eliminating the need for other friction-reducing additives.

The present invention provides phase change materials (PCMs), compositions that include the PCMs and microencapsulated phase change materials (MPCMs), and methods for using the PCMs and MPCMs, and PCM compositions.

In one aspect, the invention provides a method for more effective coating of a substrate via enhancing the tribological and mechanical performance of the coating. In certain embodiments, the coating comprises a coating polymer and a phase change material (PCM).

While a coating provides some level of protection to the substrate through preventing direct contact between the external loading and sliding with substrate, this comes at the cost of the wear of the coating. In the present invention, PCM is added to the coating and enhances mostly tribological and minimally mechanical properties of the coating. The PCM as an additive substantially reduces the wear and friction generated on the coating, thus indirectly protecting the substrate as well.

In the practice of the invention, PCMs serve as lubricants and wear reduction materials. When a PCM-containing coated substrate is subjected to a load (e.g., interacting surfaces), the PCM in that coating melts in situ thereby removing heat due to friction (reduces thermal distortion of coated substrate). In addition, by becoming a liquid, the PCM functions as a liquid lubricant acting to reduce the friction coefficient, to reduce the wear, and to reduce the generated heat for the interacting surfaces.

In certain embodiments, the phase change material is encapsulated in a polymer, ceramic, or other material.

The present invention provides three different ways for incorporating PCM (e.g., a paraffin) into polymeric high bearing materials (such as aromatic thermosetting copolyesters (ATSP) and polyetheretherketones (PEEK).

The first utilizes bulk (i.e., not capsulated) PCM. In this example, PCM was applied as a film on an ATSP coating through mechanical application. See FIGS. 1 and 2, indicated as ATSP+P_film.

Figure 1:
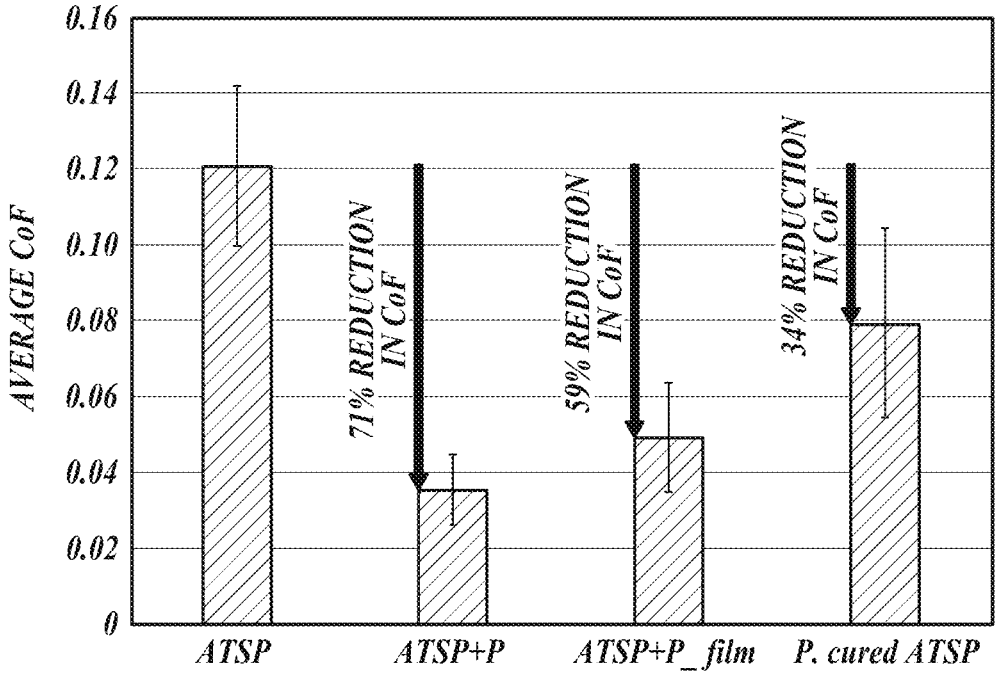
FIG. 1 compares average coefficient of friction (CoF) for representative coatings of the invention compared to a polymeric high bearing material (ATSP).
Figure 2:
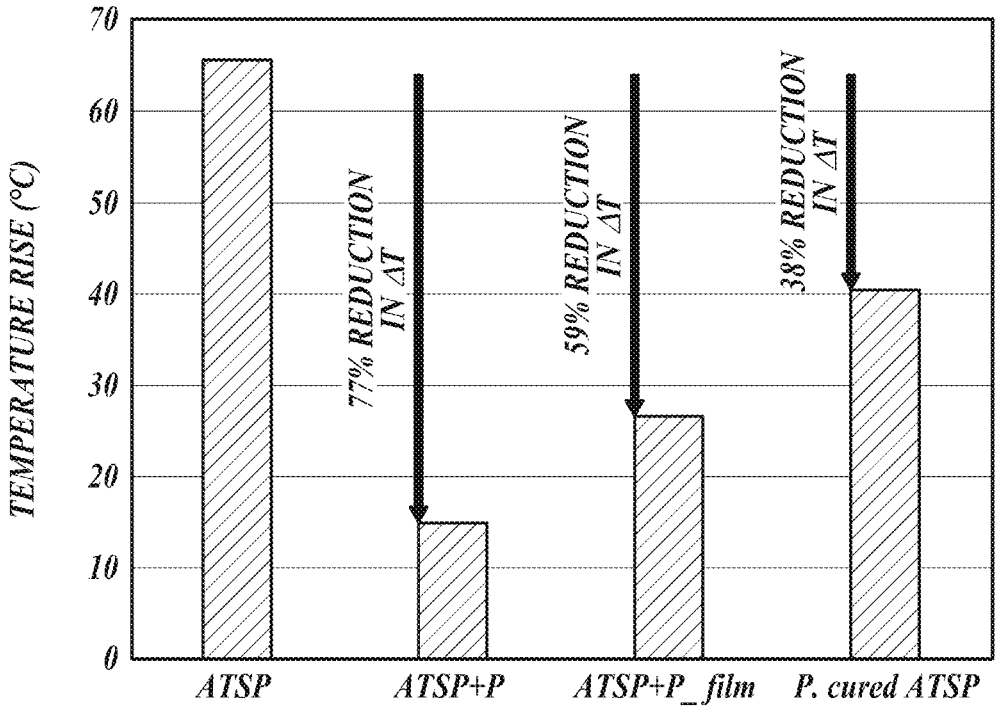
FIG. 2 compares the reduction in frictional heat generation for the coatings described in FIG. 1.

The second utilizes bulk PCM applied on a polymeric coating (e.g., ATSP coating) similar to the first technique noted above, however the resulting coated surface was treated by heating in an oven at 80° C. (higher than the melting temperature of the PCM, for example, PCM 43° C.) for 24 hrs. This process allows for a minimal infuse of PCM into the coating. Once the coated disk was removed from the oven, the surface was cleaned (wiping papers and isopropanol) to remove any excess PCM. This coating is indicated in FIGS. 1 and 2 as P. cured ATSP.

The third utilizes microencapsulated PCM (MPCM or MEPCM) (paraffin encapsulated in a polymer shell). MPCM (or MEPCM) is a two component structure: shell and core. The shell is a polymeric material such as PMMA, and the core is a PCM such as a paraffin. The shell generally has a much higher thermal stability; in the practice of the present invention up to 350 to 400° C. The coating material can be any polymer such as ATSP or PEEK. In certain embodiments of the present invention, from about 5 to about 10% of the MPCM are blended with the coating polymer (e.g., ATSP) to make a blended coating. Encapsulation of the PCM with a polymeric shell is a complex polymerization process that does not occur by simply mixing bulk PCM with a paraffin followed by sintering.

MPCMs offer advantages over PCMs. Organic PCMs, such as stearic acid or paraffins, have low melting and evaporation temperatures compared to the sintering temperature of most bearing grade polymers. Thus, such PCMs cannot survive the curing or sintering process. However, encapsulation (shell) of PCMs allows for embedding of the PCM in the bearing grade polymers. Without encapsulation, the PCMs would otherwise evaporate during sintering or curing.

Representative MPCMs have the appearance of a powder. The size of the particles that constitute the powder could be from nanometers to millimeters. This powder was mechanically mixed with a polymeric high bearing material (e.g., ATSP powder) and was cured on the substrate. In this technique, encapsulated PCM is embedded in the ATSP coating during curing, compared to the first and second techniques noted above, in which the bulk PCM was added later on the cured ATSP coating. This coating is indicated in FIGS. 1 and 2 as ATSP+P.

Thus, in certain embodiments, the method comprises coating a surface of the substance with a combination of the phase change material and a polymeric material. In certain of these embodiments, the coating is formed from a powdered phase change material and a powdered polymeric material. In certain embodiments, the combination of the phase change material and a polymeric material comprises from about 5 to at least 10 percent by weight encapsulated phase change material. See, for example, ATSP+P in FIGS. 1 and 2.

In other embodiments, the substrate comprises a polymer coating and the phase change material forms a coating on the polymer coating. In certain of these embodiments, the polymer coating is formed from a polymeric material. See, for example, ATSP+P_film in FIGS. 1 and 2.

In further embodiments, the substrate comprises a polymer coating and the phase change material is infused into the polymer coating. In certain of these embodiments, the polymer coating is formed from a polymeric material. See, for example, P. cured ATSP in FIGS. 1 and 2.

In certain embodiments of the methods, the coating is formed from a powdered phase change material (e.g., particle size from about 4 to about 70 μm).

The coating provided by the methods of the invention can have a varied thickness depending on the desired use. In certain embodiments, the coating has a thickness from about 35 to about 1 mm. In other embodiments, the coating has a thickness from about 35 to about 50 μm. In further embodiments, the coating has a thickness from about 50 to about 100 μm. In yet other embodiments, the coating has a thickness from about 100 μm to about 1 mm. When the coating has a thickness greater than about 1 mm, the coating constitutes a blended bulk material.

In certain embodiments of the methods, the substrate is a polymeric substrate, a metallic substrate, or a ceramic substrate. In certain embodiments, the substrate is a stainless steel substrate.

In certain embodiments of the methods, the polymeric material is ATSP, PEEK, polyimide, or PTFE. In certain embodiments, the polymeric material is ATSP.

The following is a description of the use of phase change materials in the methods of the invention and the advantages provided.

Phase Change Materials

In the practice of the invention, the phase change material is selected from organic, inorganic, or eutectic phase change materials. Suitable PCMs include organic phase changing materials, such as paraffins, inorganic phase changing materials, such as salt hydrates, and eutectic phase change materials, such as inorganic-inorganic compounds encapsulated in polymeric or/and ceramic shells or in raw additive form.

PCMs have phase transitions across a vast range of temperatures (e.g., from 0 to 800° C.) and therefore PCMs can be selected for their advantageous use in the methods of the invention depending on the temperature encountered during operating conditions, Examples of PCMs having melting temperatures in the range from about 0 to about 100° C. include clathrates, fatty acids, paraffins, and salt hydrates. Examples of PCMs having melting temperatures in the range from about 100 to 200° C. include sugar alcohols. Salts are examples of PCMs having melting temperatures in the range from about 150 to greater than about 800° C. and include nitrates, hydroxides, chlorides, carbonates, and fluorides.

Figure 12:
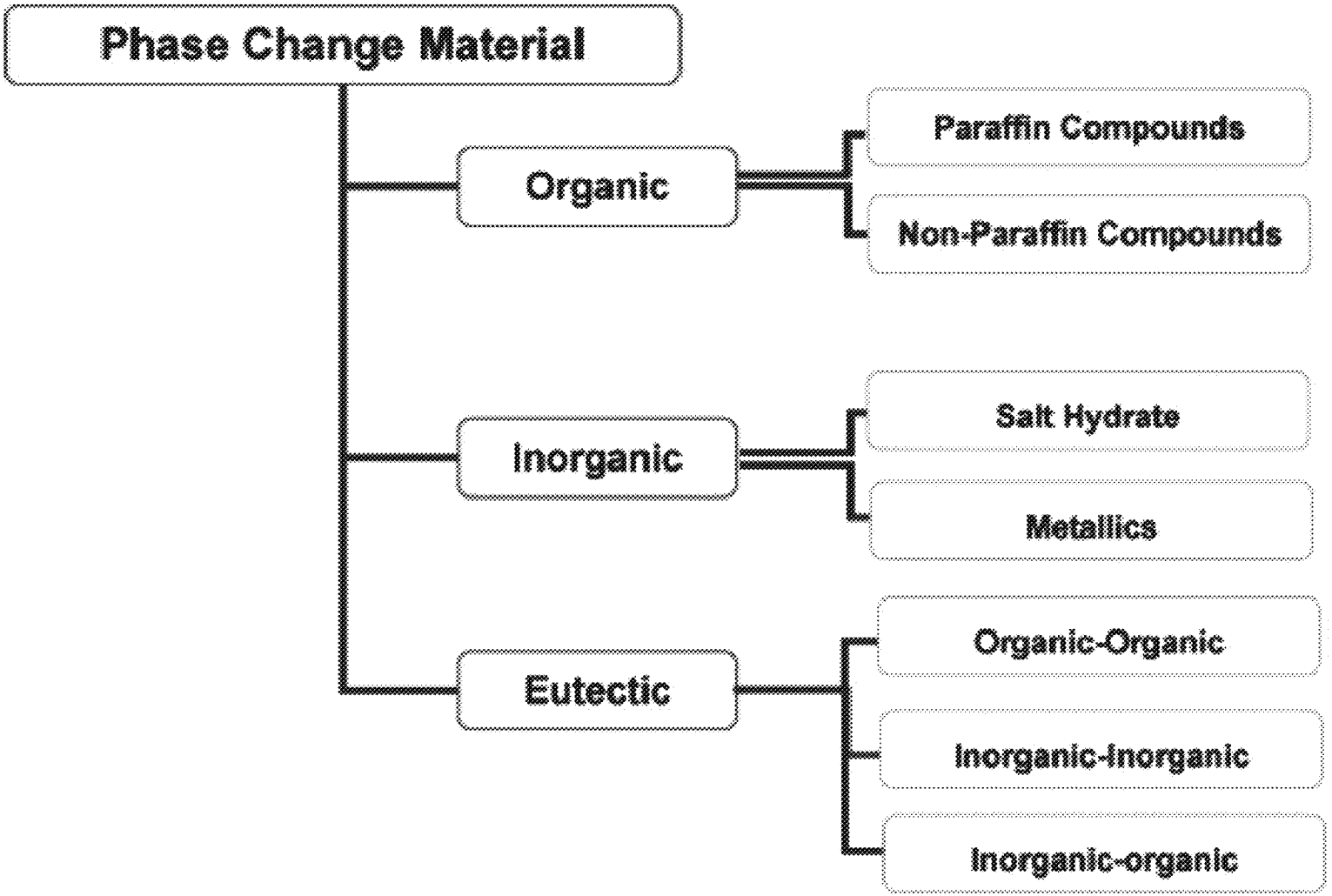
FIG. 12 shows types of phase change materials.

Representative phase change materials are described below. Types of phase change materials are shown in FIG. 12 (see also Shaima, Atul, et al. "Review on thermal energy storage with phase change materials and applications." *Renewable and Sustainable Energy Reviews* 13.2 (2009): 318-345).

Representative paraffins useful as PCMs in the methods of the invention are summarized in FIG. 13 (see also Sutterlin, W. R. "Phase Change Materials, A Brief Comparison of Ice Packs, Salts, Paraffins, and Vegetable-derived Phase Change Materials." *Pharmaceutical Outsourcing* (2011)).

In certain embodiments, the phase change material is a paraffin (e.g., a paraffin with a melting point of about 43° C.).

Substrates Treated with Phase Change Materials

In another aspect, the invention provides a substrate having a surface coated with a phase change material prepared by the methods described herein. Representative substrates include polymeric, metal (e.g., steel, such as stainless steel), alloy (e.g., aluminum alloy), and ceramic substrates.

The present invention provides phase change materials (PCMs) (also referred to herein as phase change additives, PCAs), compositions that include the PCMs, and methods for using the PCMs and PCM compositions.

These materials and compositions greatly enhance the friction and wear (tribological) performance of polymers, as well as ceramics and metals, in both bulk and coating formats. Blending specially selected and precisely manufactured encapsulated phase change materials with polymeric and/or ceramic encapsulations in coatings reduces their friction coefficient and wear rates and contribute to remarkable economical savings in the form of slashing the energy consumption and component wear and failure. As the PCMs activate at different temperatures and conditions, they are tunable for specific application conditions.

The invention implements both raw PCMs, and processed PCMs, such as encapsulated ones. The invention also provides blends of PCMs with advanced polymeric high bearing materials, such as aromatic thermosetting copolyesters (ATSP) and polyetheretherketone (PEEK). Encapsulated PCMs and polymeric high bearing materials can be blended in powder form and then the blend is coated on a surface, or made into a bulk material using known manufacturing techniques.

The PCMs used in present invention include paraffin materials encapsulated in polymeric shells with particle size smaller than 100 microns (microencapsulated paraffin material, MPCM). The powder is mechanically mixed with the polymer that forms the matrix of the coating. Then the blend was coated on metallic substrate using electrostatic spray coating and cured in an oven at elevated temperatures.

The present invention provides for the implementation of PCMs as lubricating and shape-sustaining additives to enhance the tribological, mechanical and thermal performance of polymers and non-polymers. Implementing the latent heat of PCMs to reduce the thermal distortion as well as utilizing the lower shear strength of PCMs to reduce frictional energy consumption and wear rate are advantageous aspects of this invention.

The materials and compositions of the invention can be used as friction reducers, wear resistance enhancers, and thermal distortion resistors to existing polymers, ceramics, among other materials, to significantly enhance the life span and energy consumption of machinery components.

While other additives in solid or liquid phase exist that could enhance the friction and wear performance of polymers and non-polymers, these additives are more expensive, more complicated, and less effective in reducing the friction and wear as well as sustaining the geometry of materials at high temperature. High bearing polymer materials have a dry coefficient of friction (CoF) of 0.1-0.3 and in accordance with the present invention, dry contact CoF is reduced to <0.04. In addition, because PCMs are tunable (specific PCMs have phase transitions across a vast range of temperatures, from 0 to 800° C.), combinations of different PCMs can be used to be effective under specific and various operating conditions.

This invention benefits an innately different operating characteristic because the enhancement in lubrication and wear performance is not merely dependent on reducing the cohesion forces and shear reduction. It is also due to a transition from a solid phase to a liquid phase, which could potentially transform the lubrication regime. Moreover, the invention provides a multipurpose material as this could also absorb the heat flow within the material without significant thermal expansion, thus maintain the shape of the designed part at high temperatures. Shape distortion because of thermal expansion is a major drawback in most polymers, which limits their applications to low and moderate temperatures. Traditionally engineers rely on using polytetrafluoroethylene (PTFE) in stronger (such as ATSP and PEEK) polymer materials to reduce the friction. PCMs offer additional advantages, especially reducing the COF to less than 0.1 (which is typical for many polymer materials), and specifically to less than 0.04.

Different types of paraffins (PCMs) in aromatic thermosetting copolyester (ATSP) were tested as coatings. The PCMs utilized were purchased from Microtek Lab and have commercial names nextek. In these tests, the core is paraffin and the shell is a polymer. These PCMs are all in microencapsulated form (i.e., MPCMs or MEPCMs) and physically have an appearance of a white powder with mean particle size of 15-30 microns. Tested MPCMs with core melting temperature of 6° C., 43° C., and 65° C. have commercial names nextek 6D, nextek 43D, and nextek 65D, respectively. All these MPCMs have a similar shell polymeric material and the only difference is core material.

MPCM 43D was tested at different weight ratios (i.e., 5%, 10%, and 20%) relative to ATSP to investigate the effect of MPCM concentration on friction and wear performance of polymer coatings. In this study the coating material was ATSP (an aromatic thermosetting copolyester commercially available under the designation NOWE™ from ATSP Innovations/EnterpriseWorks, 60 Hazelwood Dr, Champaign, Ill. 61820).

To understand the role of the polymer coating (matrix) on the blended coating performance (i.e., matrix+MPCM), PEEK coatings were also tested (The Chemours Company, 1007 Market Street P.O. Box 2047, Wilmington, Del. 19899 US/DuPont™ 532-1003). For all PEEK coatings that were tested, electrostatic spray coating technique was implemented. For PEEK coatings, because of the higher curing temperature (390° C.) most of the MPCM was destroyed because the limitations of the thermal stability of the shell material of the MPCMs. However, with the limited surviving particles, significantly lower friction coefficient was observed for low cycles of the tests. The efficacy of the MPCM is weakened as the tests continues and the friction coefficient increases and approaches the friction coefficient of neat PEEK after 8,000 cycles. However, in case of ATSP, a stable consistent friction coefficient even after 38,000 cycles was observed and showed 80% reduction compared to neat ATSP.

Bulk PCM docosane in PTFE coating was tested using the infusion technique. Docosane is a paraffin and it is the core material used in nextek 43D. A layer of bulk PCM 43 on the already cured PTFE-coated O1 steel disk was heated in an oven at 80° C. for 24 hours. The coated disk was removed and excess PCM was removed (most of the PCM was absorbed by the coating).

While the presented data is focused on depositing a thin layer of the polymer+MPCM blend, one could easily generate thicker bodies of the blend by change the manufacturing technique. Parts could be made by sintering a blend of neat polymer in form of powder or granule with MPCM. In this technique the produced part could have significantly higher thicknesses, however it exhibits the same friction and wear performance when exposed to a sliding motion. The only difference is the manufacturing technique, while similar material and compositions are used.

Effect of Various MPCMs on the Wear and Friction Performance of ATSP Coating

Neat ATSP (CB2AB2) was coated on O1 steel disks and was tested against O1 steel pin at 1 MPa of contact pressure and 1 m/s of sliding velocity at room temperature without any type of external lubrication. Similar tests were conducted on disks with blends of ATSP+MPCM with a consistent and constant weight ratio of 90% ATSP/10% MPCM. Types of MPCM, obtained average friction coefficient+one standard deviation, near contact temperature at the end of the test, and the temperature increase as a result of frictional heat generation are shown in Table 1.

TABLE 1

Effect of types of MPCM on friction and frictional heat generation.

| Coating composition | Average COF | Near contact temperature | Temperature increase |
|---|---|---|---|
| Neat ATSP | 0.285 ± 0.102 | 112.5° C. | 87.0° C. |
| ATSP + MPCM 6D | 0.409 ± 0.114 | 82.8° C. | 55.5° C. |
| ATSP + MPCM 43D | 0.051 ± 0.005 | 47.5° C. | 21.4° C. |
| ATSP + MPCM 65D | 0.053 ± 0.008 | 42.5° C. | 16.6° C. |

While the addition of MPCM CD resulted in an increase in the friction coefficient compared to neat ATSP, the near contact temperature increase is not as high as neat ATSP. Both MPCM 65D and MPCM 43D resulted in lower friction coefficient values compared to neat ATSP and noticeably reduced the near contact temperature. The decrease in near contact temperature is caused by two mechanisms, namely, lower friction forces thus less kinematic energy converted to frictional heat and by absorbing the generated frictional heat which is consumed by PCM to undergo phase change process.

Figure 9A:
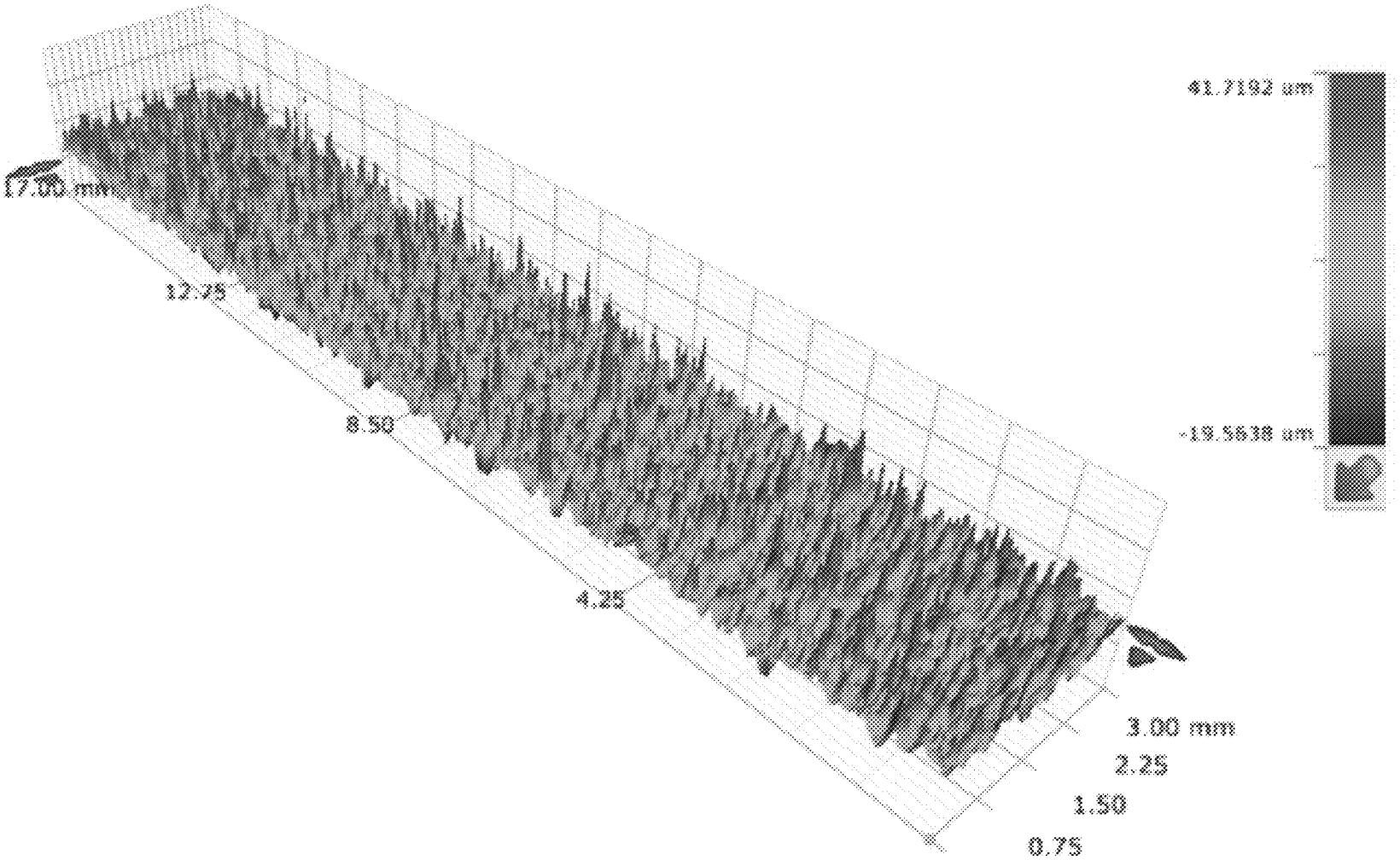
FIGS. 9A-9D illustrate wear intensity as shown by 3D topography obtained on the disks coated with untested neat ATSP (9A), tested neat ATSP (9B), tested ATSP+10% MPCM 6D (9C), and tested ATSP+10% MPCM 43D (9D).
Figure 9B:
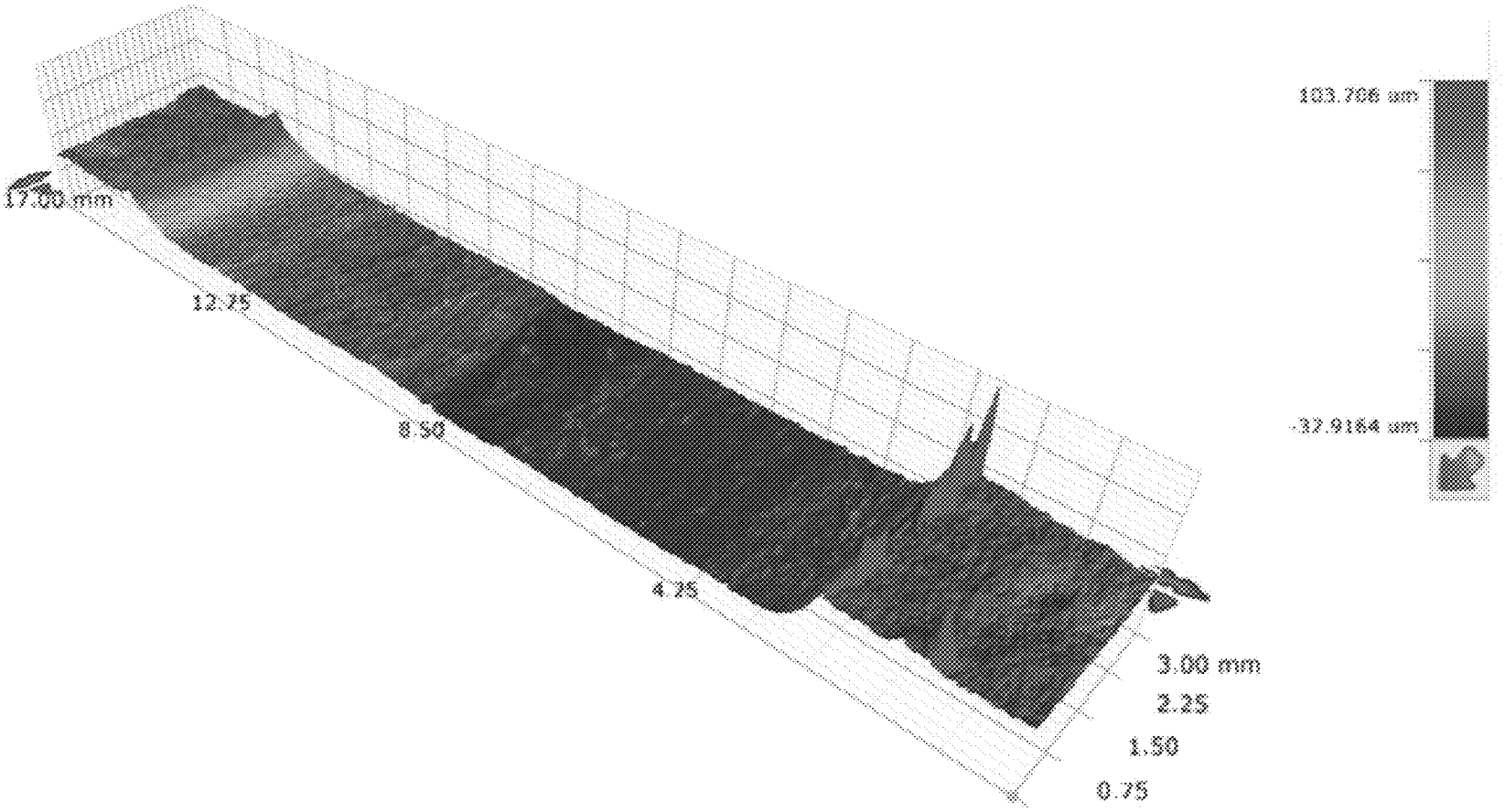
Figure 9C:
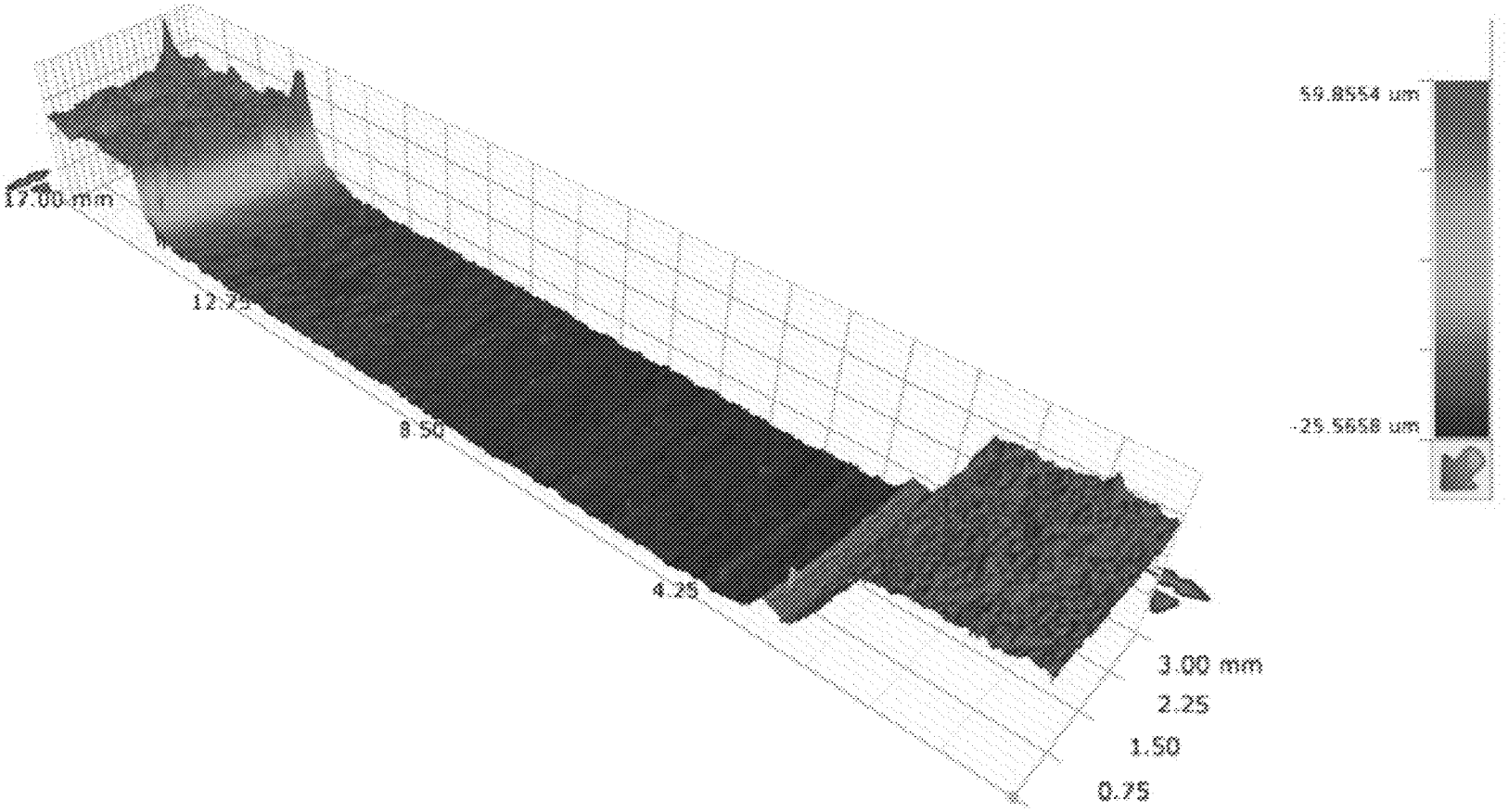
Figure 9D:
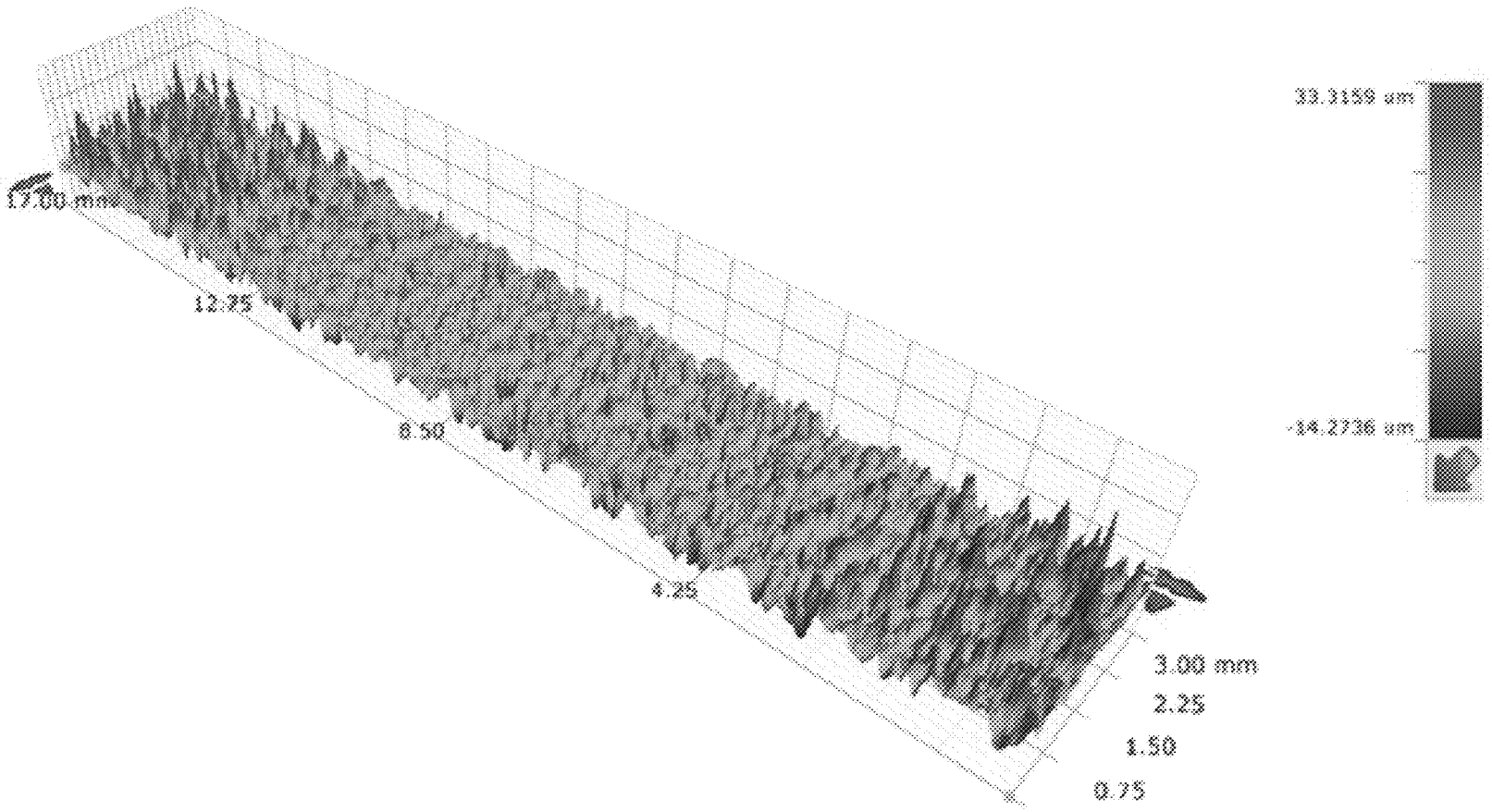

Due to sliding motion of the coated disk under a normal load against the pin, the surface experienced harsh abrasive conditions, which results in gradual removal of the coating material. Better lubrication condition could alleviate the abrasion and result in lower wear of the material. Wear intensity on the coatings were dramatically different as well as friction coefficients. Introducing MPCM resulted in notable reduction in wear intensity of the ATSP coating. FIGS. 9A-9D depict the 3D topography of different coatings after test. Before the test surface topography of ATSP and ATSP+MPCMs are similar thus only topography of untested ATSP+10% MPCM 43D is shown. FIGS. 9A-9D demonstrate the remarkable enhancement of wear resistance of the polymer as a result of blending the neat polymer with the right MPCM. In fact, in case of neat ATSP as shown in FIG. 9B the average depth of the wear track (i.e., the depth to which the coating material was removed as a result of sliding against the pin) is close to 38 microns. However, as a result of blending the neat ATSP with 10% MPCM 43D, as shown in FIG. 9D, the wear track shows no penetration into the bulk and is limited to the removal of the surface high peaks. A maximum removal depth of 1 micron could be estimated. In the case of blending the ATSP with 10% MPCM 6D, the wear is reduced as well as shown in FIG. 9C. The wear track depth associated with this blend is close to 25 microns. This further illustrates the reduction of wear intensity by blending the neat polymer with selected MPCM, however it also accentuates the importance of selecting the optimized MPCM for a specific application.

Another notable aspect of the invention is the effect of MPCM in reducing the vibrations and noise that the contact generates. MPCMs 43D and 65D reduced the noise and vibration substantially and transformed a noisy contact to a practically silent contact.

Effect of MPCM/Polymer Mass Ratio on the Wear and Friction Performance of ATSP Coating To study the effect of MPCM concentration in the blended coating composition, ATSP/MPCM coatings with powder mixing ratio $$\left(\text{i.e., } M_R = \frac{m_{MPCM}}{m_{MPCM} + m_{ATSP}}\right)$$

of 5%, 10%, and 20% were produced on O1 steel disks. Testing conditions were identical with a contact pressure of 1 MPa and sliding velocity of 1 m/s.

Figure 10:
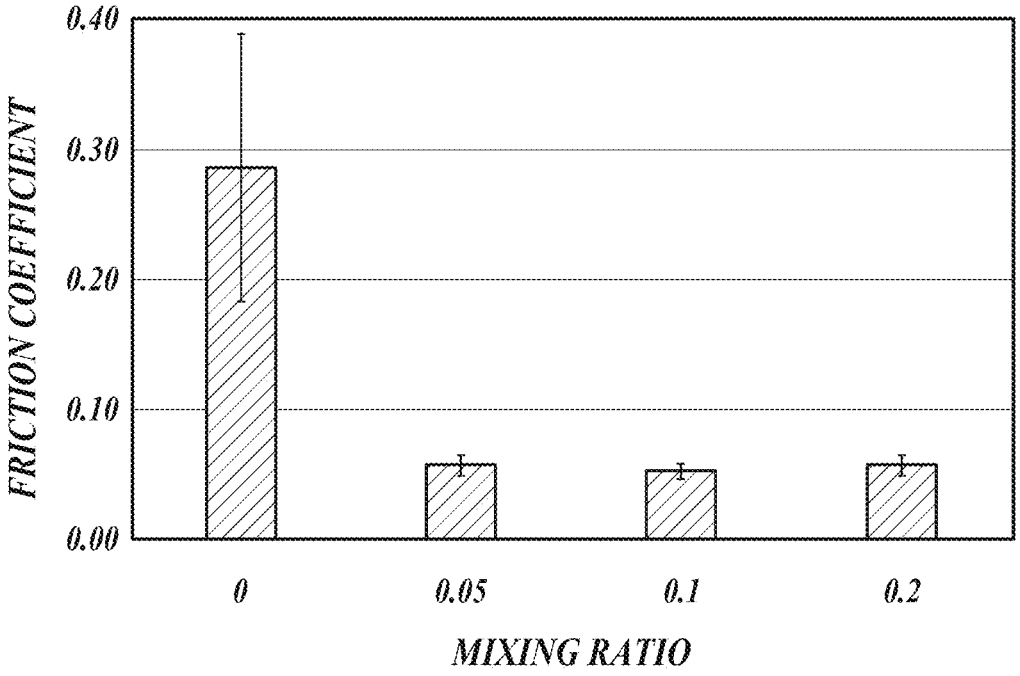
FIG. 10 illustrates the effect of mixing ratio of the MPCM in ATSP coating on the friction coefficient (CoF).

FIG. 10 compares the average in the friction coefficient obtained for each coating composition under identical testing conditions. The friction coefficient that was obtained for neat ATSP $M_{R=0}$% was included as a control value.

Figure 11A:
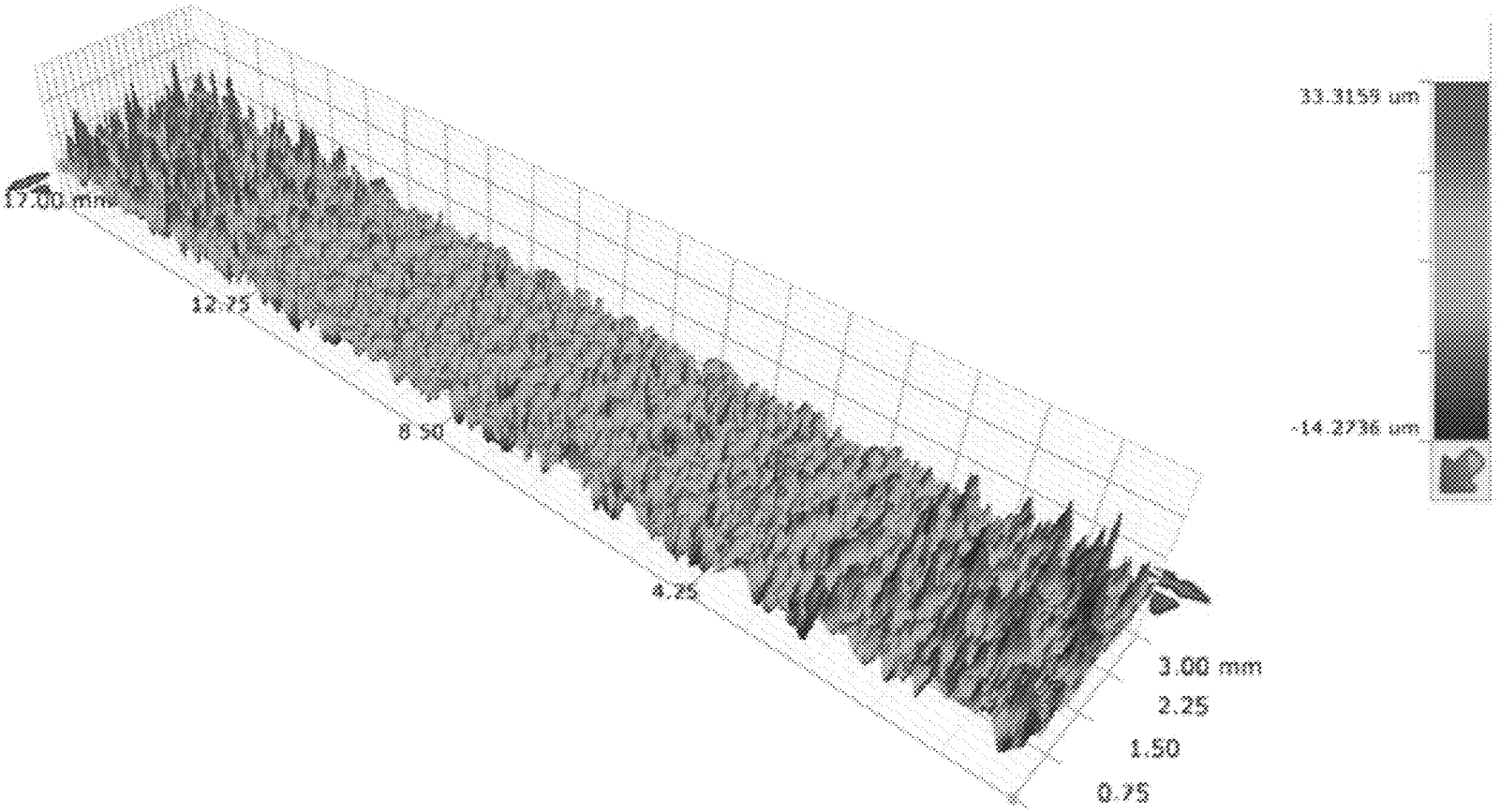
FIGS. 11A and 11B illustrate the wear track as shown by 3D topography after tests for ATSP+MPCM coatings with mixing ratio of 10% (11A) and 20% (11B).
Figure 11B:
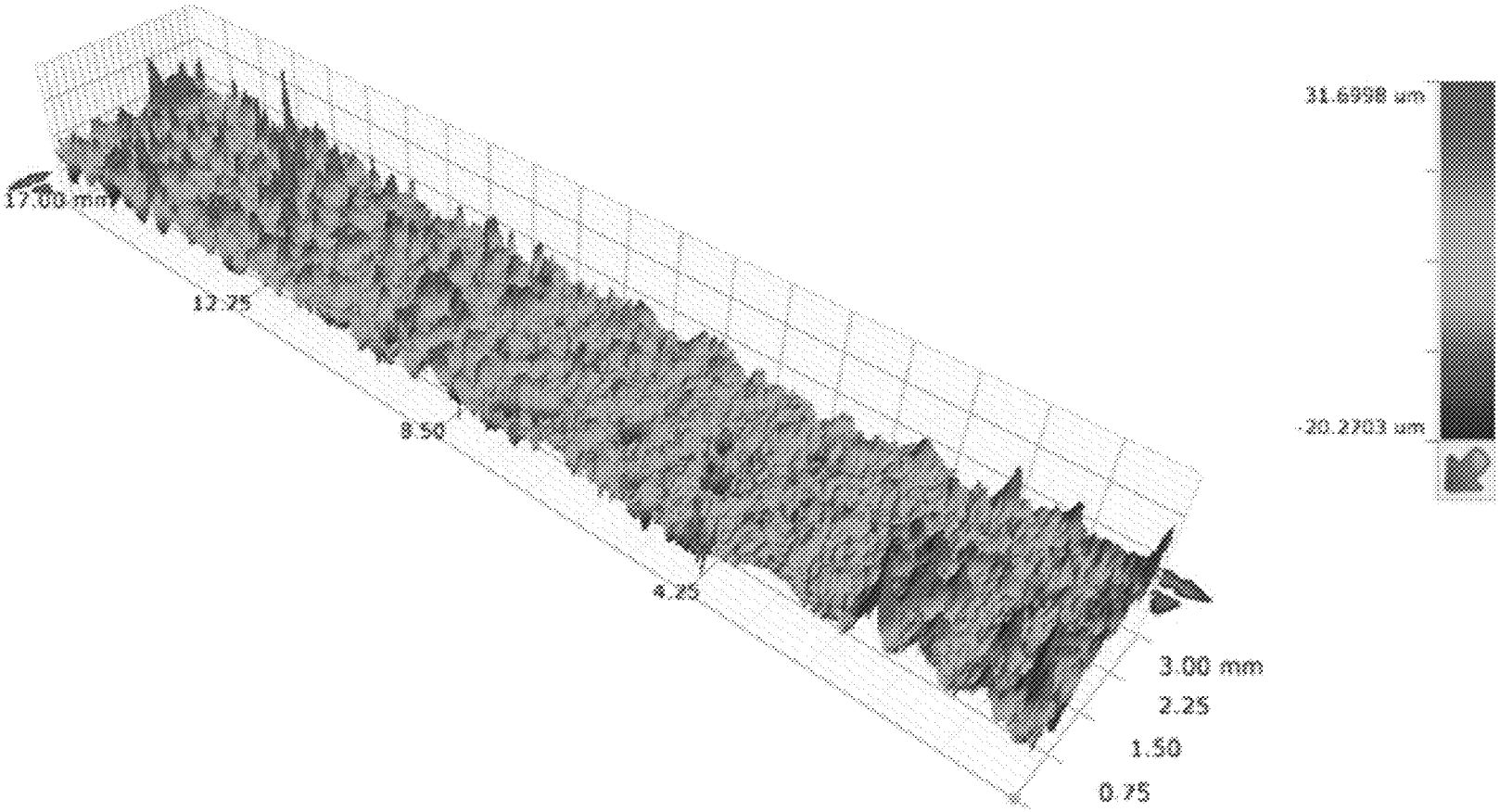

The mixing ratio did not affect the fiction coefficient significantly. The wear intensity however exhibited slight improvement as the mixing ratio increased. FIGS. 11A and 11B illustrate the 3-dimensional topography of a slice of the wear track obtained on the ATSP+MPCM 43D coatings by a Tencor XD profilometer.

Effect of Polymer Matrix on the Wear and Friction Performance Polymer/MPCM Composition Coatings Most of the tested coatings benefited ATSP as the polymer matrix. To understand the role of polymer on the matrix, polyether ether ketone (PEEK) polymer (POSSIBLE MISSIONS INC., 150 W. Parker Road Suite 602 Houston, Tex. 77076/Polyetheretherketone powder) was selected as an alternative. Neat PEEK coating as well PEEK+10% MPCM 43D were produced and the friction coefficient was studied under identical conditions. Contact pressure of 1 MPa and sliding velocity of 1 m/s were used as testing conditions. The coatings were produced using electrostatic spray technique, the same as ATSP+MPCM coatings. However, because the curing temperature of PEEK is significantly higher than ATSP, the majority of the MPCM particles were decomposed during the curing process. This is due to the limited thermal stability of the MPCM shells, which could not fully withstand the cure temperature of the PEEK. Despite this fact, enhanced friction behavior was observed due to limited surviving MPCM particles in the coating. For low cycle tests (8,000 cycles) a remarkable 44% reduction is observed in COF, however as the test proceeded the friction reduction efficacy of the additive is diminished.

Friction coefficients as low as 0.018 were observed using MPCM 43D for lower contact loads, thus the attainable lower limit of the friction coefficient using this invention is unknown to us however this the lowest value we have reached so far.

Paraffin selection depends on the application and operational condition. For a medium load, medium velocity condition MPCM 65D and MPCM 43D both have excellent performance.

As used herein, the term "about" refers to ±5% of the specified value. The following examples are provided for the purpose of illustrating, not limiting, the invention.

EXAMPLE 1

Reducing Coefficient of Friction and Preventing Excessive Heat Generation in Representative Coatings In this example, the average coefficient of friction (CoF) and heat removal for representative coatings of the invention was determined and compared to a representative polymeric high bearing material (ATSP). The results are compared in FIGS. 1 and 2.

Figure 3:
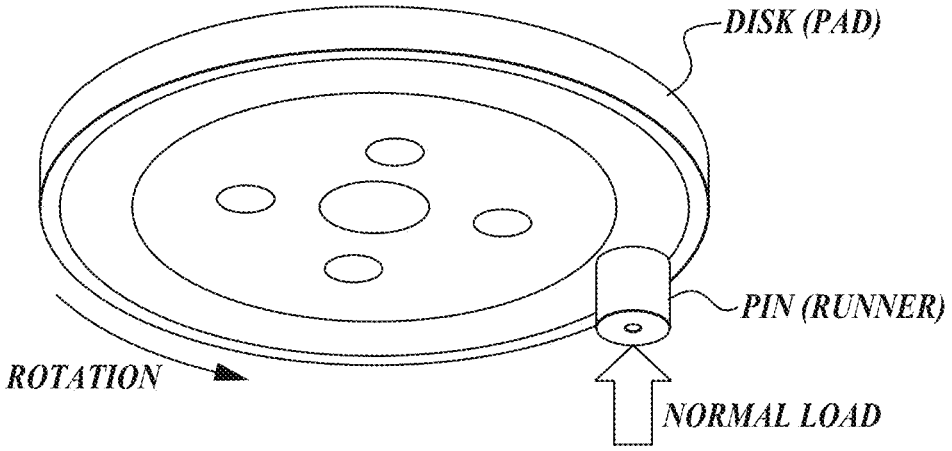
FIG. 3 is an illustration of pin-on-disk configuration, polymeric pin models the stationary pad in a pad bearing.

A pin-on-disk test as shown in FIG. 3 was used to obtain the coefficient of friction. In this setup, a normal controlled load is applied on the pin which is a cylinder made of O1 steel. The O1 steel disk which is thoroughly coated with ATSP for the control case and ATSP+PCM for other cases is brought in contact with the pin. The disk is connected to an electrical motor through a shaft. Once the normal load reached the set load of 10 MPa, the disk started to rotate and reached a sliding velocity of 1.8 m/s. The resistance (friction) forces generated because of this sliding motion was measured using load cells which were connected to the pin holder assembly and were recorded using an automated system. CoF was calculated as the ratio of the total friction forces (resistance forces) to the applied normal force. To measure the near contact temperature, a thermocouple was inserted in the pin through a hole machined into it which was drilled down to 1 mm below the surface. The recorded temperature is directly correlated to the actual contact temperature.

Representative polymer encapsulated paraffins include those prepared from polymers such as melamine-formaldehyde, poly urea-formaldehyde, and polymethylmethacrylate polymers, and paraffins such as n-docosane and n-tricosane.

A representative MPCM (polymer encapsulated paraffin) (Microtek Laboratories, 2400 E River Rd, Dayton, Ohio 45439/Nextek) was blended with an advanced polymeric high bearing material powder [an aromatic thermosetting copolyester (ATSP), commercially available under the designation NOWE™ from ATSP Innovations/Enterprise-Works, 60 Hazelwood Dr, Champaign, Ill. 61820] (using 5, 10, and 20 percent by weight phase change material and then coated on O1 steel. In addition, neat ATSP was coated on O1 steel as control. The coatings had thickness form about 35 to about 50 microns. In another experiment, ATSP/PFTE (95/5% weight ratio) was used and a 71% reduction in CoF was observed.

Samples were tested under harsh operational conditions experimentally (i.e., normal contact pressure of 0.5-10 MPa and sliding speeds of 0.01-2 m/s) and showed a remarkable 60% reduction in the friction coefficient, 70% reduction in wear, and 75% reduction in generated heat. The comparison was with a state of the art ATSP/PTFE coating as control.

FIG. 1 compares average coefficient of friction (CoF) for representative coatings of the invention compared to a polymeric high bearing material (ATSP) coating. ATSP+P refers to a coating prepared from a combination of a powdered representative phase change material (polymer encapsulated paraffin) and a powdered polymeric high bearing material (5 to about 10 percent by weight phase change material). ATSP+P_film refers to a layer of the phase change material (paraffin) on a polymeric high bearing material (ATSP) coating. P. cured ATSP refers to a layer of a phase change material (paraffin) on a polymeric high bearing material (ATSP) coating that was then heated to infuse the phase change material in the polymeric high bearing material. These coatings were applied on an O1 tool steel substrate (coating thickness 35-50 microns) (1 micron=1 $\mu m=1\times10^{-6}$ meters).

FIG. 2 compares suppression of frictional heat for the coatings described in FIG. 1.

EXAMPLE 2

Coefficient of Friction and Wear Resistance of Disks Treated with Representative Coatings In this example, the coefficient of friction, contact temperature, and wear resistance of disks treated with representative coatings of the invention was determined and compared to untreated disks.

Materials

Encapsulated and bulk PCMs were selected. The selections were based on temperature criteria such as: melting temperature of the PCM, thermal stability of the encapsulating polymer (i.e., shell), and viscosity of the PCM at the operating temperature.

MPCM (polymer encapsulated paraffin) was added to the cured ATSP powder (NOWE™) before hot pressing. Mixing ratio was 5% and 10% by weight MPCM to the total weight of MPCM and ATSP (i.e., ATSP+5% MPCM and ATSP+10% MPCM).

Encapsulated PCM endured the high temperature of curing process, thus PCM integrated in the structure of polymer.

A metallic disk (O1 tool steel disk) was coated (40 μm) with the bland of ATSP+MPCM. The coated disk was tested side-by-side with O1 steel disk coated with neat ATSP.

Coefficient of Friction and Contact Heat

Test Procedure. Disks coated with ATSP+PCM and untreated disks were prepared as described above. A tribometer, a specialized apparatus to measure the in situ friction force at different preset normal forces was employed to measure the friction force generated by sliding the coated disks against a stainless steel pin (Advanced Mechanical Technology, Inc., 176 Waltham Street, Watertown, Mass. 02472; or RTec Instruments, 1810 Oakland, Road B, San Jose, Calif. 9513). This is a standardized test called "in-on-disk" test to measure the friction coefficient (i.e., generated friction force divided by applied normal force to a sliding contact), in most tribological contacts.

COF=friction force/normal force

Friction coefficient determines the amount of lost energy in a sliding contact, thus the lower the better.

Testing Conditions 500 rpm=1.8 m/s

Normal force=25 lbf (111 N)

10 minutes test duration

Figure 4:
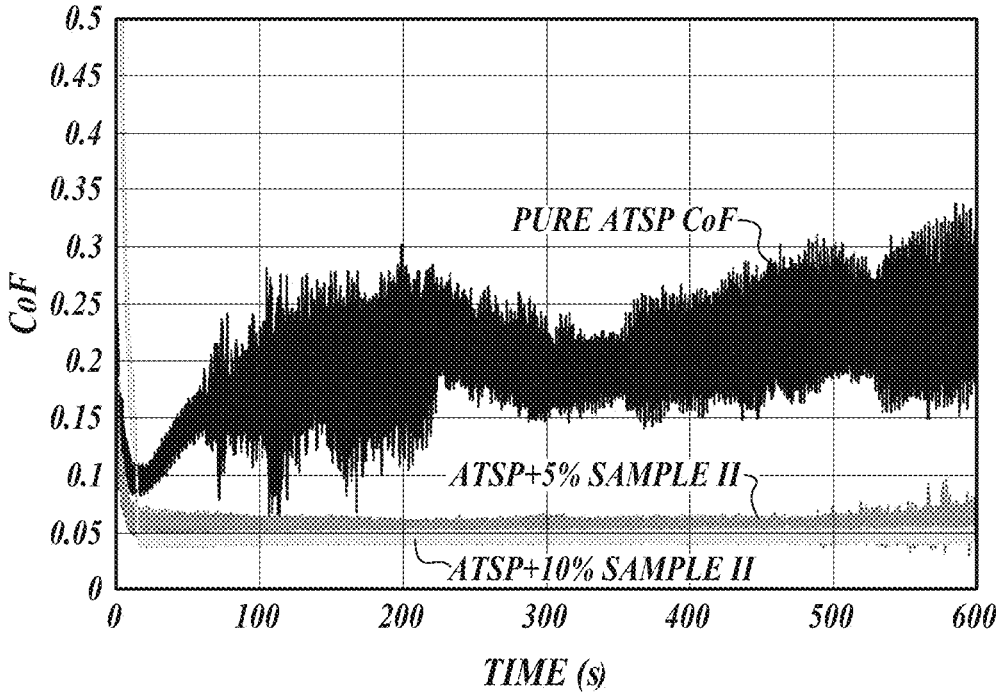
FIG. 4 compares the coefficient of friction (CoF) for representative coatings of the invention (ATSP+5% PCM and ATSP+10% PCM) relative to control (ATSP).

Test Results. The coefficient of friction test results are shown in FIG. 4 and coefficient of friction test results and contact temperature are summarized in Table 2.

TABLE 2

| Coating | Average COF | Near Contact Temperature |
|---|---|---|
| ATSP | 0.23 | 108° C. |
| ATSP + 5% MPCM | 0.06 | 54° C. |
| ATSP + 10% MPCM | 0.05 | 47° C. |

MPCM at 5% concentration resulted in remarkably lower friction coefficient. In addition, PCM stabilized the contact, meaning that the magnitude and trend of oscillations was alleviated clearly. PCM at ATSP-1-10% MPCM further reduced the friction and the oscillations. Lower friction results in lower heat generation and lower contact temperature.

Disk Wear

Test Procedure. To calculate the wear of disks, surface profilometry was implemented. Briefly, a needle-like stylus traverses (slides) over the surface at a very low normal force. Through measuring the vertical motion of the probe during its horizontal motion, the surface profile is obtained. The scar that metallic pin creates on the polymer surface is referred to as wear track.

Figure 5:
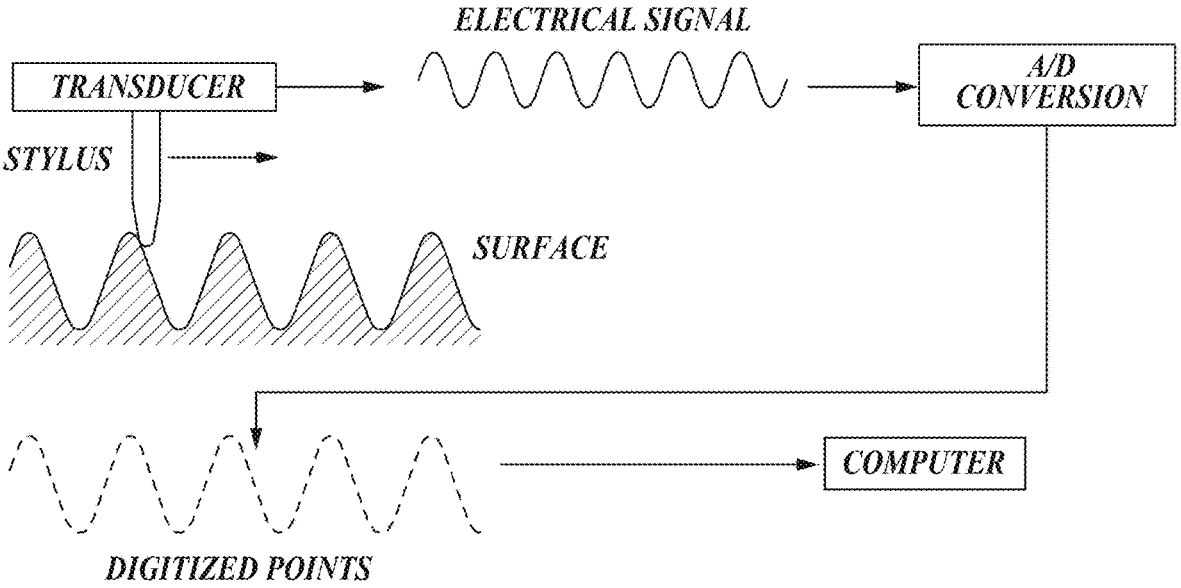
FIG. 5 is a schematic illustration of the profilometer operation.
Figure 6A:
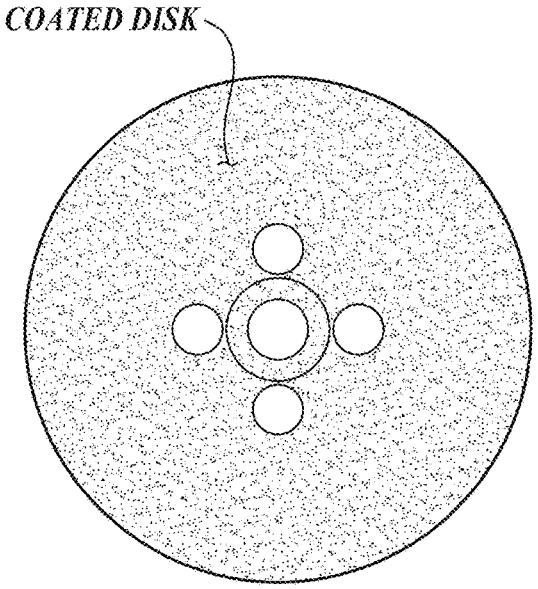
FIGS. 6A and 6B are images of the coated disk before (6A) and after (6B) wear testing.
Figure 6B:
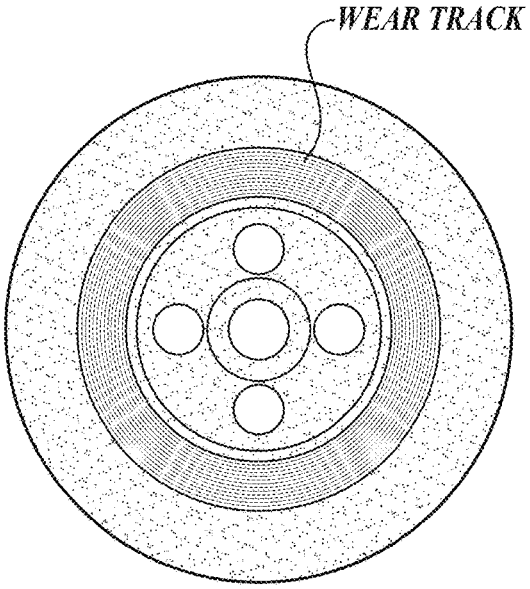
Figure 7:
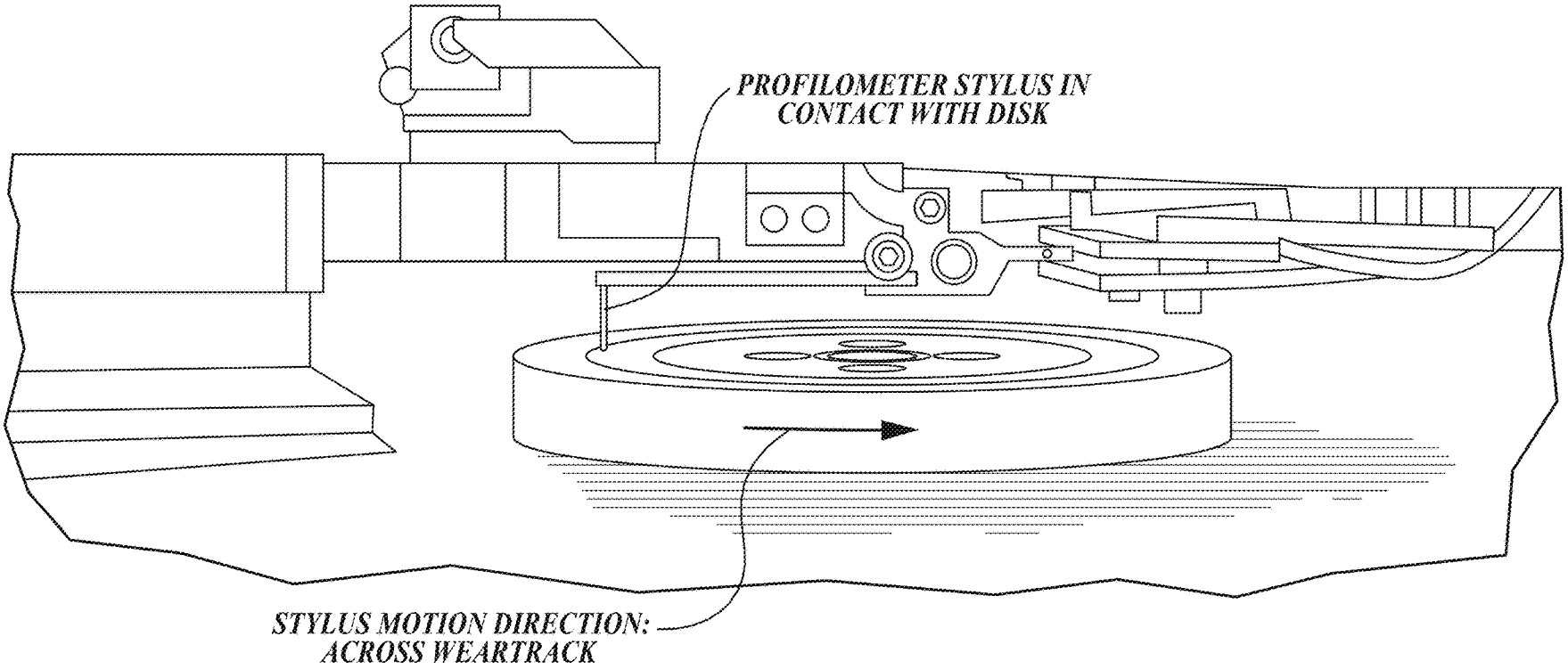
FIG. 7 is a schematic of the coated disk in the profiler used to determine surface profile and wear track.
Figure 8:
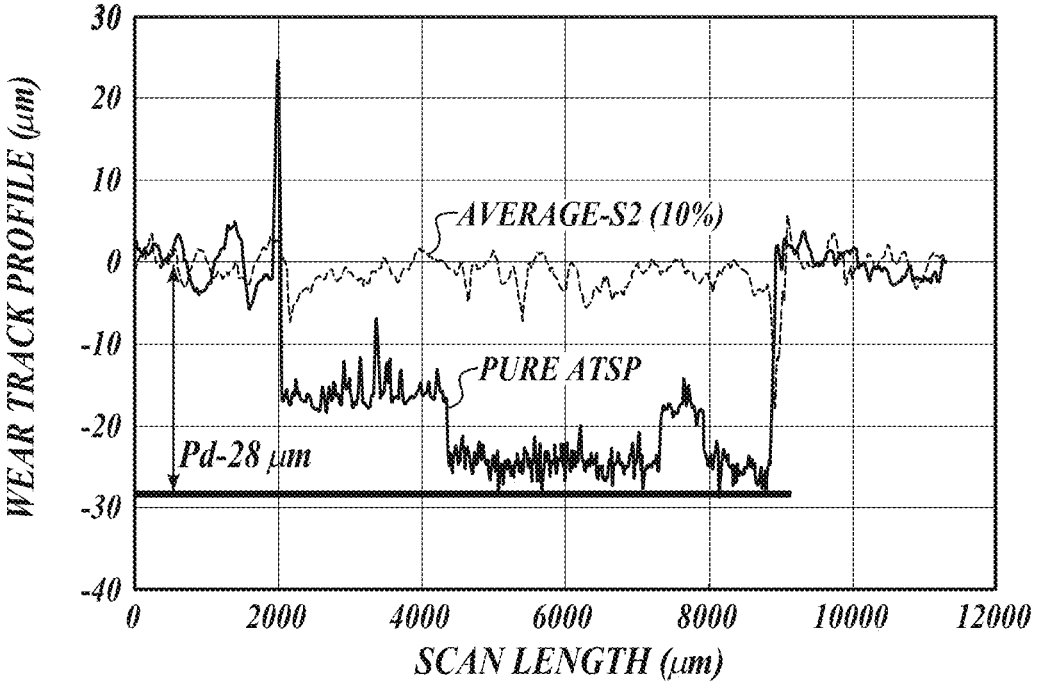
FIG. 8 compares the wear track profile (μm) of a disk coated with a representative coating of the invention (ATSP+10% PCM) relative to a control disk (coated with ATSP).

The operation mechanism of a profilometer (Dektak XD model from Bruker Dektak Company), wear track on the disk after the tests, and disk in profilometer are shown in FIGS. 5-7, The obtained profiles are shown in FIG. 8.

The wear track shows the amount of worn material on the disks. Surface profile of the wear tracks for the polymer and polymer+MPCM (10% PCM) were obtained and shown in FIG. 8.

Test Results. Referring to FIG. 8, PCM reduced the wear of the polymer significantly because of the effective lubrication of the surface by the PCM as well as maintaining the contact temperature, both of which contribute to wear reduction.

While illustrative embodiments have been illustrated and described, it will be appreciated that various changes can be made therein without departing from the spirit and scope of the invention.

The embodiments of the invention in which an exclusive property or privilege is claimed are defined as follows:

1. A method for coating a substrate to enhance the tribological and mechanical performance of a coating, comprising coating a surface of the substrate with a phase change material composition, wherein the phase change material composition is a combination of a phase change material and a polymeric material, and wherein the polymeric material is an aromatic thermosetting copolyester.

2. The method of claim 1, wherein the phase change material composition is a phase change material coated on the polymeric.

3. The method of claim 2, wherein the phase change material forms a film on the polymeric.

4. The method of claim 2 further comprising heating the phase change material coated on the polymeric material to provide a coating wherein the phase change material is infused into the polymeric material.

5. The method of claim 1, wherein the phase change material is selected from the group consisting of organic, inorganic, and eutectic phase change materials.

6. The method of claim 1, wherein the phase change material is a paraffin.

7. The method of claim 1, wherein the phase change material is a paraffin having a melting point from about 40° C. to about 65° C.

8. The method of claim 2, wherein the combination of the phase change material and the polymeric material comprises from about 2 to about 20 percent by weight phase change material.

9. The method of claim 1, wherein the phase change material composition is a phase change material encapsulated in an encapsulating polymer.

10. The method of claim 9, wherein the phase change material is a paraffin.

11. The method of claim 9, wherein the phase change material is n-docosane or n-tricosane.

12. The method of claim 9, wherein the encapsulating polymer is a melamine-formaldehyde polymer, a polyurea-formaldehyde polymer, a polymethylmethacrylate polymer, or mixtures thereof.

13. The method of claim 2, wherein the coating is formed from a powdered phase change material and a powdered polymeric material.

14. The method of claim 2, wherein the coating has a thickness from about 35 μm to about 1 mm.

15. The method of claim 1, wherein the substrate is a polymeric substrate, a metallic substrate, a metal alloy substrate, or a ceramic substrate.

16. The method of claim 1, wherein the substrate is a stainless steel substrate.

17. A substrate having a surface coated with a phase change material prepared by the method of claim 1.

* * * * *